US008413289B1

(12) United States Patent
Dondurur et al.

(10) Patent No.: US 8,413,289 B1
(45) Date of Patent: Apr. 9, 2013

(54) MULTIPLE PAINT ROLLER HOLDER

(75) Inventors: Mehmet Dondurur, Dhahran (SA); Ahmet Z. Sahin, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 13/311,480

(22) Filed: Dec. 5, 2011

(51) Int. Cl.
*B05C 17/02* (2006.01)

(52) U.S. Cl.
USPC ..... 15/230.11; 492/13; 492/19

(58) Field of Classification Search ..... 15/230.11; 492/13, 16, 19
See application file for complete search history.

(56) References Cited

U.S. PATENT DOCUMENTS

| | | | | |
|---|---|---|---|---|
| 2,257,316 | A | 9/1941 | Votaw et al. | |
| 2,805,436 | A | 9/1957 | Christensen et al. | |
| 2,824,328 | A * | 2/1958 | Bedford | 15/230.11 |
| 3,205,526 | A | 9/1965 | Archibald | |
| 3,593,361 | A | 7/1971 | Welt | |
| 6,141,821 | A | 11/2000 | Chin | |
| 6,219,877 | B1 | 4/2001 | Lowrey et al. | |
| 6,957,470 | B2 * | 10/2005 | Rivadeneira | 15/230.11 |
| 6,973,696 | B1 | 12/2005 | Koumarianos | |
| 7,007,337 | B2 | 3/2006 | Finochiaro et al. | |
| 7,043,793 | B2 | 5/2006 | Lu | |
| 7,293,319 | B2 | 11/2007 | Charbeneau | |
| D602,696 | S | 10/2009 | Morad et al. | |
| 8,015,651 | B2 * | 9/2011 | Knopow et al. | 15/104.002 |
| 2007/0143946 | A1 | 6/2007 | Kim | |

FOREIGN PATENT DOCUMENTS

DE 38 13 939 A1 11/1989

OTHER PUBLICATIONS

HYDE Dual Flex Paint Roller, Lab Safety website, http://www.labsafety.com/hyde-dual-flex-paint-rollers_s_150027/?isredirect=true.

* cited by examiner

*Primary Examiner* — Laura C Guidotti
(74) *Attorney, Agent, or Firm* — Richard C. Litman

(57) ABSTRACT

The multiple paint roller holder includes a roller frame and a handle connected to the roller frame. The handle is preferably connected to the frame by a bent or angled neck to place the handle in a raised position. The roller frame includes an upper cross member having corresponding upper roller holding pins, a lower cross member having corresponding lower roller holding pins, and an center beam interconnecting the upper and lower cross members. Each pair of upper roller holding pin and lower roller holding pin rotatably holds a paint roller therebetween. The upper cross member includes members pivotally joined end-to-end in a U-shaped saddle at the upper end of the center beam by a setscrew.

9 Claims, 2 Drawing Sheets

MULTIPLE PAINT ROLLER HOLDER

BACKGROUND OF THE INVENTION

1. Field of the Invention

The present invention relates to painting devices, and particularly to a multiple paint roller holder that provides fast performance and increased versatility.

2. Description of the Related Art

Painting one's living and working environment to suit one's aesthetics and décor has been a common practice for a long time. Many painting devices are available to facilitate this task, and these devices range from simple paintbrushes to powered spray painters. The paint roller is one of the most common painting devices in current use. These typically include a single paint roller rotatably mounted to a holder. A handle is usually attached to the holder for the user to push and pull during the process of painting a surface. While the conventional paint roller can paint surfaces satisfactorily, it is a time-consuming and inefficient activity. The user must repeatedly dip the roller in a pan of paint because the amount of paint or charge in the roller usually does not last long. This also leads to constant repainting over sections already worked in an effort to obtain an even coat due to uneven application of paint from a near-depleted roller. Moreover, the construction of the typical paint roller devices limits the painting strokes to the vertical, up and down directions on the surface being painted.

Thus, a multiple paint roller holder solving the aforementioned problems is desired.

SUMMARY OF THE INVENTION

The multiple paint roller holder includes a roller frame and a handle connected to the roller frame. The handle is preferably connected to the frame by a bent or angled neck to place the handle in a raised position. The roller frame includes an upper cross member having corresponding upper roller holding pins, a lower cross member having corresponding lower roller holding pins, and an center beam interconnecting the upper and lower cross members. Each pair of upper roller holding pins and lower roller holding pins rotatably holds a paint roller therebetween. The upper cross member is constructed from two members that are pivotally joined to a U-shaped saddle at the upper end of the center beam by a setscrew. Selective loosening of the setscrew permits the two members to pivot out for installation of a plurality of paint rollers to be disposed vertically within the frame, and then pivoted back into a paint roller holding position. Selective tightening of the setscrew sets the desired pivoted position of the sub-members. The multiple paint rollers held thereby facilitate faster painting of surfaces.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
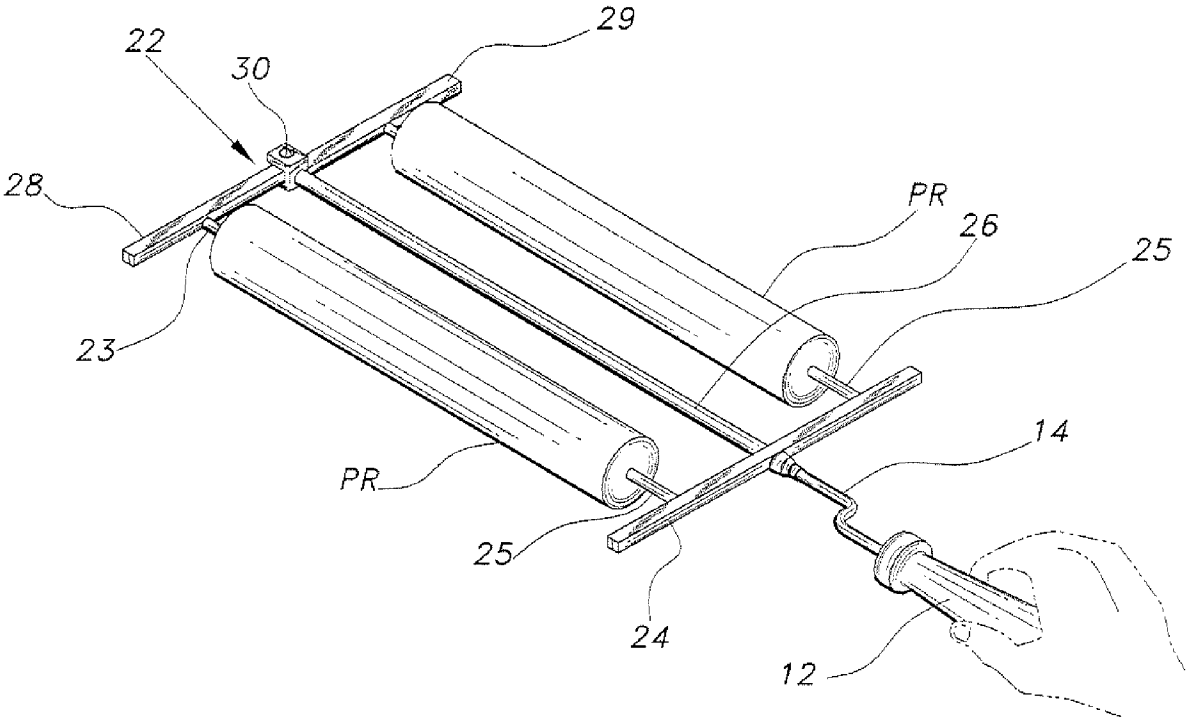
FIG. 1 is an environmental, perspective view of a multiple paint roller holder according to the present invention.
Figure 2:
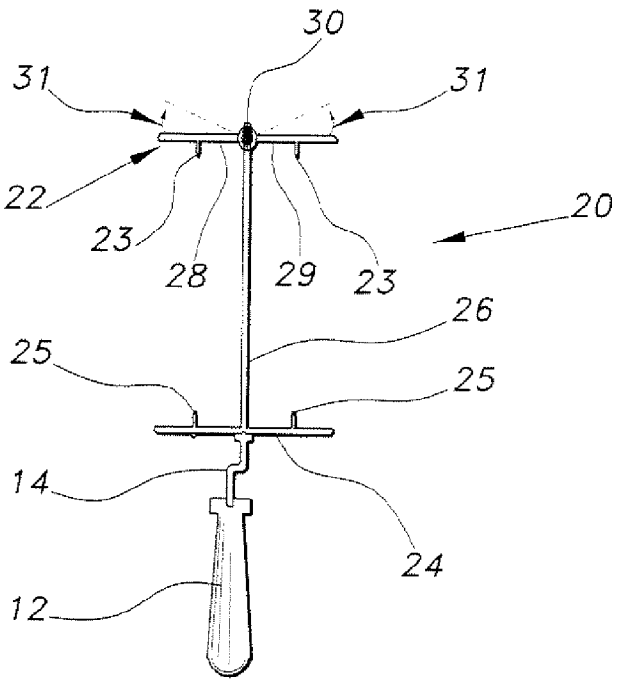
FIG. 2 is a plan view of the multiple paint roller holder of FIG. 1.

The multiple paint roller holder, a first embodiment of which is generally referred to in the drawings by the reference number 10, provides faster execution of the task with improved versatility for painting in various directions. As shown in FIGS. 1 and 2, the multiple paint roller holder 10 includes a roller frame 20 for holding a plurality of paint rollers PR and a handle 12 attached thereto. The handle 12 includes an elongate neck 14 mounted directly to the roller frame 20. The connection can be fixed, freely rotating or selectively oriented at an angle. The neck 14 is preferably configured as a bent neck forming a zigzag pattern as shown, or as a straight neck disposed at an angle with respect to the connection to the roller frame 20. The bent neck 14 permits the user to hold the handle 12 at a raised, comfortable position from the surface being painted for moving the roller frame 20 in any desired direction, e.g., horizontal, vertical, arcuate and points between. In this manner, the user can maneuver the multiple painter roller holder 10 without the hand scraping or undesirably touching the painting surface. The handle 12 can be provided in any length and shape from hand-sized to pole length. Although the handle 12 is preferably offset from the plane of the frame 20, the handle 12 and neck 14 can be straight and lie substantially in the same plane as the roller frame 20.

As mentioned above, the multiple paint roller holder 10 is constructed to hold a plurality of paint rollers PR. To facilitate this, the roller frame 20 includes an upper cross member, beam, bar or rod 22, a lower cross member, beam, bar or rod 24 spaced from the upper cross member 22, and an elongate center member, beam, bar or rod 26 joining the upper and lower cross members 22, 24 together. The upper cross member 22 includes at least a pair of spaced roller holding pins 23 extending towards the lower cross member 24. In a similar manner, the lower cross member 24 also includes at least a pair of spaced roller holding pins 25 extending towards the upper cross member 22. Each pair of upper roller holding pins 23 and lower holding pins 25 is aligned with each other, and they are constructed to be inserted into the opposite ends of a paint roller PR to rotatably hold the same. With the construction above and shown in FIGS. 1 and 2, two paint rollers PR can be vertically mounted to the roller frame 20 at one time. However, more than the two paint rollers PR can be mounted to the roller frame 20 by lengthening the cross members 22, 24 and adding additional upper and lower roller holding pins 23, 25.

The plurality of paint rollers PR allow for faster and thereby more efficient painting of surfaces because it eliminates much of the repetitious passes required to paint a given surface area compared to a single paint roller holder. With a conventional single paint roller holder, the user must repeatedly paint over the path already traveled by the single paint roller holder because of the splotches left behind in the initial pass. This is often caused by insufficient paint transfer when the paint roller traverses the surface. In contrast, the additional paint roller(s) PR in the multiple paint roller holder 10 substantially reduces the need for such additional passes. The trailing rollers insure that the splotched areas from the leading roller will be covered with paint during a single pass.

The roller frame 20 also includes features for accommodating paint rollers PR of various sizes and easy installation thereof. As shown in FIGS. 1 and 2, the upper cross member 22 is constructed from members 28 and 29 that are pivotally joined to each other at their ends, as indicated by the arrow 31. The members 28, 29 are pivotally mounted to each other in a U-shaped saddle at the upper end of the center beam 26 by a setscrew 30 attaching the ends of the members 28, 29. The setscrew 30 can include a raised section or portion for easy manipulation by the user. Selective loosening of the setscrew 30 permits the members 28, 29 to be pivoted out, thereby widening the gap for placing or removing the paint rollers PR on or from the roller frame 20. Different lengths and widths of paint rollers can be accommodated by this function of the pivoting members 28, 29. Once one end of the paint rollers PR is installed onto the lower roller holding pins 25, the sub-members 28, 29 are pivoted towards the lower cross member 22 so that the upper roller holding pins 23 insert into the opposite ends of the paint rollers PR. The setscrew 30 is then tightened to securely hold the paint rollers PR vertically in the roller frame 20. Alternatively, the selective pivoting and setting of the sub-members 28, 29 can be facilitated by other locking and/or clamping mechanisms, such as locking pins and biased detents.

Figure 3:
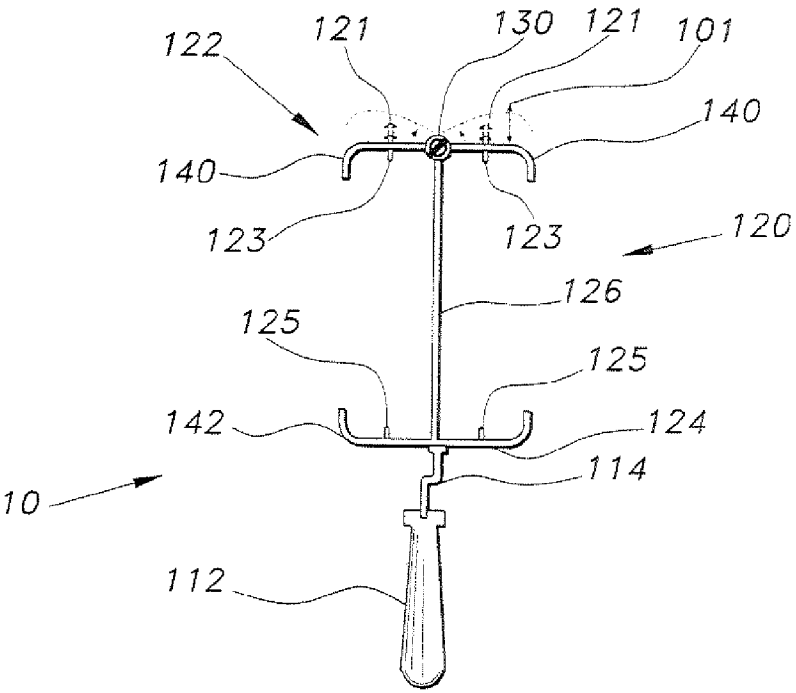
FIG. 3 is a plan view of an alternative embodiment of a multiple paint roller holder according to the present invention.

An alternative embodiment of a multiple paint roller holder 100 is shown in FIG. 3. In this embodiment, the multiple paint roller holder 100 is substantially the same as the multiple paint roller holder 10. The multiple paint roller holder 100 includes a handle 112, a neck 114, an upper cross member 122 having corresponding upper roller holding pins 123, a lower cross member 124 having corresponding lower roller holding pins 125, and an elongate center beam 126. The upper cross member 122 includes two members 128, 129 pivotally mounted to the U-shaped saddle at the upper end of the center beam 126 by a setscrew 130. However, the upper cross member 122 also includes curved or arcuate outer flanges 140 extending towards the lower cross member 124. Similarly, the lower cross member 124 also includes curved or arcuate outer flanges 142 extending toward the upper cross member 122. The outer flanges 140, 142 are flexible and perform several functions. During installation of the paint rollers PR, the outer flanges 140, 142 can be flexed out of the way to make room for the installation. Moreover, the outer flanges 140, 142 act as guard rails that keep the paint rollers PR inside the roller frame 120 and buffer against any objects that may be in the way of the painting stroke. Additionally, the upper roller holding pins 123 can be provided in the form of spring-loaded pull pins, each of the pins 123 being normally biased in the position shown in solid lines. The user can quickly and easily pull the upper roller holding pin 123 by the head 121 in the direction indicated by arrow 101 to avoid any obstruction to the paint roller during installation or removal, much like a quick-release mechanism. It is to be understood, that any of the roller holding pins described above can be constructed in a similar manner. In all other respects, the multiple paint roller holder 100 functions the same of the multiple paint roller holder 10

Thus, it can be seen that the multiple paint roller holder 10, 100 allows the user to quickly and more efficiently paint desired surfaces. The pivotal members of the upper cross member 22, 122 permit quick and easy installation of various sizes of paint roller PR. The construction thereof is relatively simple, economical and versatile so that the user can paint horizontally as well as vertically with ease.

It is to be understood that the multiple paint roller holder 10, 100 encompasses a variety of alternatives. For example, the multiple paint roller holder can be constructed from wood, plastic, metal, composites and/or combinations thereof. The handle 12, 112 can be of any ergonomic shape ranging from smooth to contoured surfaces.

It is to be understood that the present invention is not limited to the embodiments described above, but encompasses any and all embodiments within the scope of the following claims.

We claim:

1. A multiple paint roller holder, comprising:

a roller holding frame adapted for holding at least a pair of paint rollers in a vertical orientation, the vertical orientation permitting horizontal painting strokes of the multiple paint roller holder, the roller holding frame having;

an elongate, upper cross member having at least two roller holding pins, each upper roller holding pin being adapted for rotatably holding one end of a paint roller, the upper cross member having two members pivotally attached to each other end-to-end;

an elongate lower cross member spaced from the upper cross member, the lower cross member having at least two roller holding pins aligned with the upper roller holding pins, each of the lower roller holding pins being adapted for rotatably holding the opposite end of the paint rollers;

an elongate center beam interconnecting the upper cross member and the lower cross member, the upper roller holding pins extending towards the lower cross member, the lower holding pins extending towards the upper cross member the center beam having a U-shaped saddle at an end thereof; and a setscrew extending through the U-shaped saddle and the pivotally attached ends of the two members forming the upper cross member, the setscrew being selectively actuable to permit pivoting the two members forming the upper cross member to facilitate insertion of the paint rollers into the frame, and selectively actuable to clamp the two members to the saddle to retain the paint rollers in the frame; and a handle attached to the roller holding frame.

2. The multiple paint roller holder according to claim 1, further comprising a neck extending from said handle to said roller holding frame.

3. The multiple paint roller holder according to claim 2, wherein said neck is bent to raise said handle above a surface to be painted.

4. The multiple paint roller holder according to claim 3, wherein said neck is bent in a zigzag pattern.

5. The multiple paint roller holder according to claim 1, wherein said upper cross member further comprises a pair of curved, outer flanges extending towards said lower cross member from opposite ends of said upper cross member, the outer flanges being symmetrically disposed to form a guard for an outer edge of adjacent paint rollers at one end of said adjacent paint rollers.

6. The multiple paint roller holder according to claim 5, wherein said lower cross member further comprises a pair of curved, outer flanges extending towards said upper cross member from opposite ends of said lower cross member, the outer flanges being symmetrically disposed to form a guard for an outer edge of adjacent paint rollers at the opposite end of adjacent paint rollers.

7. The multiple paint roller holder according to claim 6, wherein said outer flanges of said upper cross member and said lower cross member are flexible to assist access for mounting or removing said paint rollers.

8. The multiple paint roller holder according to claim 7, wherein said upper roller holding pins comprises spring-biased pull pins.

9. The multiple paint roller holder according to claim 1, wherein at least two of said upper and lower roller holding pins comprise spring-biased pull pins.

* * * * *